United States Patent [19]

Matsushita

[11] Patent Number: 4,751,508

[45] Date of Patent: Jun. 14, 1988

[54] DOT CHARACTER DISPLAY APPARATUS

[75] Inventor: Tsuyoshi Matsushita, Shizuoka, Japan

[73] Assignee: Tokyo Electric Co., Ltd., Tokyo, Japan

[21] Appl. No.: 820,563

[22] Filed: Jan. 21, 1986

[30] Foreign Application Priority Data

Feb. 5, 1985 [JP] Japan ..... 60-20563

[51] Int. Cl.[4] ..... G09G 1/00

[52] U.S. Cl. ..... 340/750; 340/735; 340/745; 340/790

[58] Field of Search ..... 340/750, 735, 721, 734, 340/745, 790, 751

[56] References Cited

U.S. PATENT DOCUMENTS

| | | | |
|---|---|---|---|
| 3,711,419 | 10/1975 | Bates et al. | 340/735 |
| 4,163,229 | 7/1979 | Bodin et al. | 340/735 |
| 4,204,208 | 5/1980 | McCarthy | 340/745 |
| 4,228,507 | 10/1980 | Leban | 340/751 |
| 4,443,794 | 4/1984 | Sakurai | 340/735 |
| 4,511,267 | 4/1985 | Pokorny et al. | 340/751 |
| 4,584,573 | 4/1986 | Ito | 340/721 |
| 4,600,920 | 7/1986 | Makita | 340/735 |
| 4,603,330 | 7/1986 | Horne et al. | 340/735 |
| 4,621,340 | 11/1986 | Pokorny et al. | 340/751 |

FOREIGN PATENT DOCUMENTS

| | | | |
|---|---|---|---|
| 0120553 | 9/1979 | Japan | 340/721 |
| 58-171981 | 10/1983 | Japan . | |

*Primary Examiner*—Marshall M. Curtis
*Assistant Examiner*—Mahmoud Fatahi-yar
*Attorney, Agent, or Firm*—Frishauf, Holtz, Goodman & Woodward

[57] ABSTRACT

A dot character display apparatus includes a control circuit for transferring data corresponding to character body and upper and lower symbols from first to third character generators to image buffers, a drive circuit for driving a dot matrix display section on the basis of the data stored in the image buffers. The dot matrix display section has an upper display area to display the upper symbol, a central display area to display the charcter body, and a lower display area to display the lower symbol. The drive circuit has a first drive section to drive the central display area of the dot matrix display section in accordance with data indicative of the character body from the first character generator, and a secod drive section to drive the upper and lower display areas of the dot matrix display section in accordance with data representative of the upper and lower symbols from the second and third character generators.

4 Claims, 6 Drawing Sheets

DOT CHARACTER DISPLAY APPARATUS

BACKGROUND OF THE INVENTION

The present invention relates to a dot character display apparatus and, more particularly, to a dot character display apparatus for displaying a complex character having a character body and a symbol added over and/or under this character body in a dot matrix display section as a dot pattern.

Generally, in dot character display apparatuses, the internal memory section is provided with character generators for generating a plurality of dot patterns each of which corresponds to each character to be displayed. For example, when character codes indicative of the characters to be displayed are inputted from an external host computer, respective bit data of the relevant dot pattern is read out from the character generators by these character codes and temporarily stored into an image buffer. Thereafter, the respective bit data stored in this image buffer is sequentially read out and respective dot display elements in the dot matrix display section are selectively activated by a matrix drive circuit in accordance with the bit data read out. Thus, the corresponding characters are displayed in the dot matrix display section.

In such a dot character display apparatus, a complex character such as "Ä" consisting of a character body and a symbol such as umlaut "¨" or the like added over the character body, as shown in FIG. 1(A), or a complex character such as "A" consisting of a character body and a symbol such as underline "—" or the like added under the character body, as shown in FIG. 2(A) are not set in the character generators since it is necessary to minimize the memory capacity. To constitute those complex characters, the data indicative of the character main bodies such as "A" and the like, the data indicative of the upper symbols such as "´", "`", "¨", "ˆ", and the like, and the data representative of the lower symbols such as "—" and the like are separately stored, respectively. For example, in the case of displaying a complex character of "Ä", as shown in FIG. 1(B), the bit data of the dot pattern of character body "A" is read out from the first character generator, the bit data of the dot pattern of the upper symbol "¨" is read out from the second character generator, and the bit data indicative of "A" and "¨" read out are synthesized in the image buffer. On the other hand, in the case of displaying a complex character of "A", as shown in FIG. 2(B), the bit data of the dot pattern of "A" is read out from the first character generator, the bit data of the dot pattern of "—" is read out from the third character generator, and the bit data read out from the first and third character generators are synthesized in the image buffer.

In general, the fundamental unit (one byte) of the data which is stored in the character generators consists of eight bits. For example, the data in the first character generator to store the dot patterns of character bodies is constituted by eight bits as a fundamental unit (one byte). The data in the second and third character generators to store the dot patterns of upper and lower symbols is constituted by four bits, respectively. The two 4-bit data from the second and third character generators are added to constitute 8-bit data.

FIG. 3 is a diagrammatical view showing a transfer state of bit data in a conventional dot character display apparatus. This dot character display apparatus includes first, second, and third character generators $CG_1$ to $CG_3$; 8-bit A- and B-registers RA and RB; a 16-bit image buffer IB having two 8-bit buffers; and a dot matrix display section DMD which is driven by a matrix drive circuit. For simplicity of explanation, this diagram shows the case where the bit data of one column is generated from the character generators and the dot matrix display section selectively energizes dot display elements of one column in accordance with this bit data.

In such a dot character display apparatus, when character code data is inputted from the outside, processes of the input character code data are executed in accordance with a flowchart of FIG. 4. First, in the case where the input character code data is the complex character code, the corresponding dot pattern is read out from second character generator $CG_2$ to store the dot pattern of upper symbol on the basis of the code indicative of the upper symbol of this complex character. The bit data at first to fourth bit positions $B_1$ to $B_4$ of each column of the dot pattern is stored at first to fourth bit positions $B_1$ to $B_4$ of A-register RA, respectively. Next, in accordance with the code representative of the character body included in the input character code data, the dot pattern of the corresponding character body is read out from the first character generator $CG_1$. The bit data at first to fourth bit positions $B_1$ to $B_4$ of the relevant column of the dot pattern is stored at the fifth to eighth bit positions of A-register RA. Further, the remaining bit data, namely, the bit data at the fifth to eighth bit positions $B_5$ to $B_8$, of the relevant column of the corresponding dot pattern generated from first character generator $CG_1$ is stored at the first to fourth bit positions in B register RB. After the bit data corresponding to the character body has been completely stored into A- and B-registers RA and RB, the relevant dot pattern is read out from third character generator $CG_3$ in accordance with the code indicative of the symbol added under the character body and is stored as lower symbol dot pattern. The bit data at first to fourth bit positions $B_1$ to $B_4$ of the dot pattern is read out and stored at the fifth to eighth bit positions of B-register RB.

After completion of storage of the respective bit data into A- and B-registers RA and RB, the respective bit data stored at the first to eighth bit positions of A-register RA is stored at the first to eighth bit positions of the image buffer. The bit data at the first to eighth bit positions of B-register RB is stored at the ninth to sixteenth bit positions of the image buffer. Thereafter, the bit data stored at the first to sixteenth bit positions of the image buffer is sent to the matrix drive circuit. The respective dot display elements of one column in the dot matrix display section are selectively energized by the matrix drive circuit. The same operation is effected for the bit data in succeeding columns of the dot pattern.

On the other hand, if the input character code data is ordinary character code instead of complex character code, it is sufficient to read out the data from only the first character generator to store the dot pattern of character body.

In the dot character display apparatus constituted as described above, each character generator and each register fundamentally handles the 8-bit data. In addition, as shown in FIG. 3, the first to sixteenth bit positions of the image buffer directly correspond to the sixteen nodes of the matrix drive circuit to energize the dot display elements on each column of the matrix display section. Therefore, in the case of displaying the character body of the complex character, it is necessary to separate each column of the dot pattern generated from first character generator $CG_1$ into upper 4-bit data and lower 4-bit data and then to store the upper and lower 4-bit data into the lower 4-bit positions of the A-register and upper 4-bit positions of the B-register, respectively.

Therefore, it is necessary to use two registers to process the respective bit data of the dot pattern of the character body read out separately from first character generator $CG_1$. Further, the control program for processing the respective bit data of the dot pattern read out becomes complicated and the data processing time increases.

SUMMARY OF THE INVENTION

It is an object of the present invention to provide a dot character display apparatus in which output bit data from a character generator in which dot patterns of character bodies are stored can be directly stored into an image buffer and a control program is simplified.

This object is accomplished by an apparatus for displaying dot characters comprising a first character generator in which a plurality of dot patterns of character bodies are stored; a second character generator in which at least one dot pattern of upper symbol is stored; a third character generator in which at least one dot pattern of lower symbol is stored; a first image buffer; a second image buffer including upper and lower memory areas; first and second matrix drive circuits; a dot matrix display section having upper, central, and lower display areas; and a control circuit for allowing first to third data respectively corresponding to the dot patterns from the first to third character generators to be stored into the first image buffer and the upper and lower memory areas of the second image buffer, respectively, controlling the first matrix drive circuit in accordance with the data stored in the first image buffer, and thereby allowing the central display area of the dot matrix display section to be driven, and at the same time this control circuit controlling the second matrix drive circuit in accordance with the data stored in the second image buffer, and thereby allowing the upper and lower display areas of the dot matrix display section to be driven.

According to this invention, the first matrix drive circuit drives the central display area of the dot matrix display section in accordance with the data stored in the first image buffer. The second matrix drive circuit drives the upper and lower display areas of the dot matrix display section in accordance with the data stored in the upper and lower memory areas of the second image buffers. Therefore, data corresponding to the dot patterns from the first to third character generators can be stored into the first image buffer and the upper and lower memory areas of the second image buffer, respectively. Due to this, for example, data representing a column of the dot pattern from the first character generator can be directly transferred to the first image buffer without passing through any register. Therefore, the construction is simplified and the data processing speed is also improved.

DETAILED DESCRIPTION OF THE PREFERRED EMBODIMENT

Figure 5:
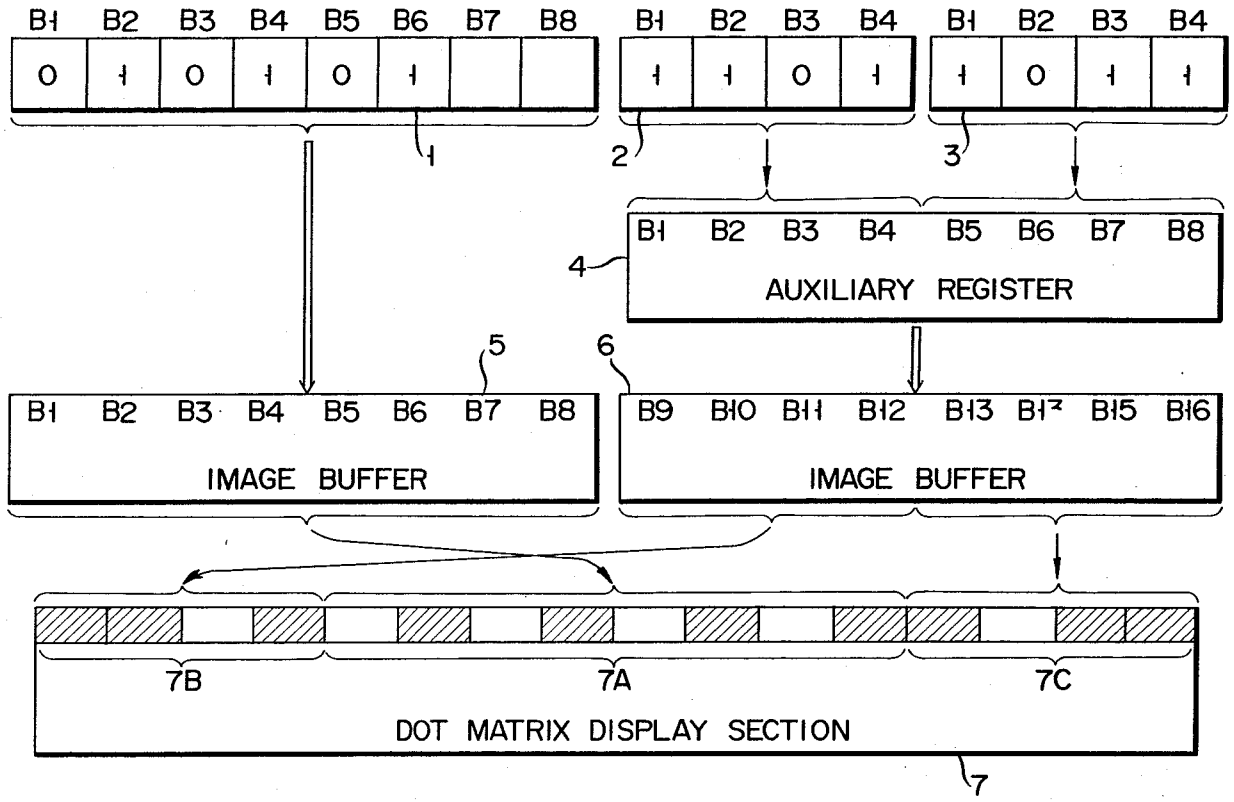
FIG. 5 shows a transfer state of bit data in a dot character display apparatus according to an embodiment of the present invention.

FIG. 5 is a diagrammatical view showing the transfer of respective bit data for displaying dot characters in an apparatus of an embodiment of the present invention. This dot character display apparatus includes a first 8-bit character generator 1 for generating dot patterns of various character bodies; a second 4-bit character generator 2 for generating dot patterns of upper symbols which are added over the character body; a third 4-bit character generator 3 for generating dot patterns of lower symbols which are added under the character body; an 8-bit auxiliary register 4; first and second image buffers 5 and 6 for storing data each fundamental unit of which is constituted by eight bits; and a dot matrix display section 7 which is driven by first and second matrix drive circuits. Dot matrix display section 7 includes $8 \times M$ dot display elements which are arranged in a matrix. For simplicity of explanation, in the diagram, each character generator and dot matrix display section show only bit positions of one column and dot display elements of one column, respectively.

Figure 6:
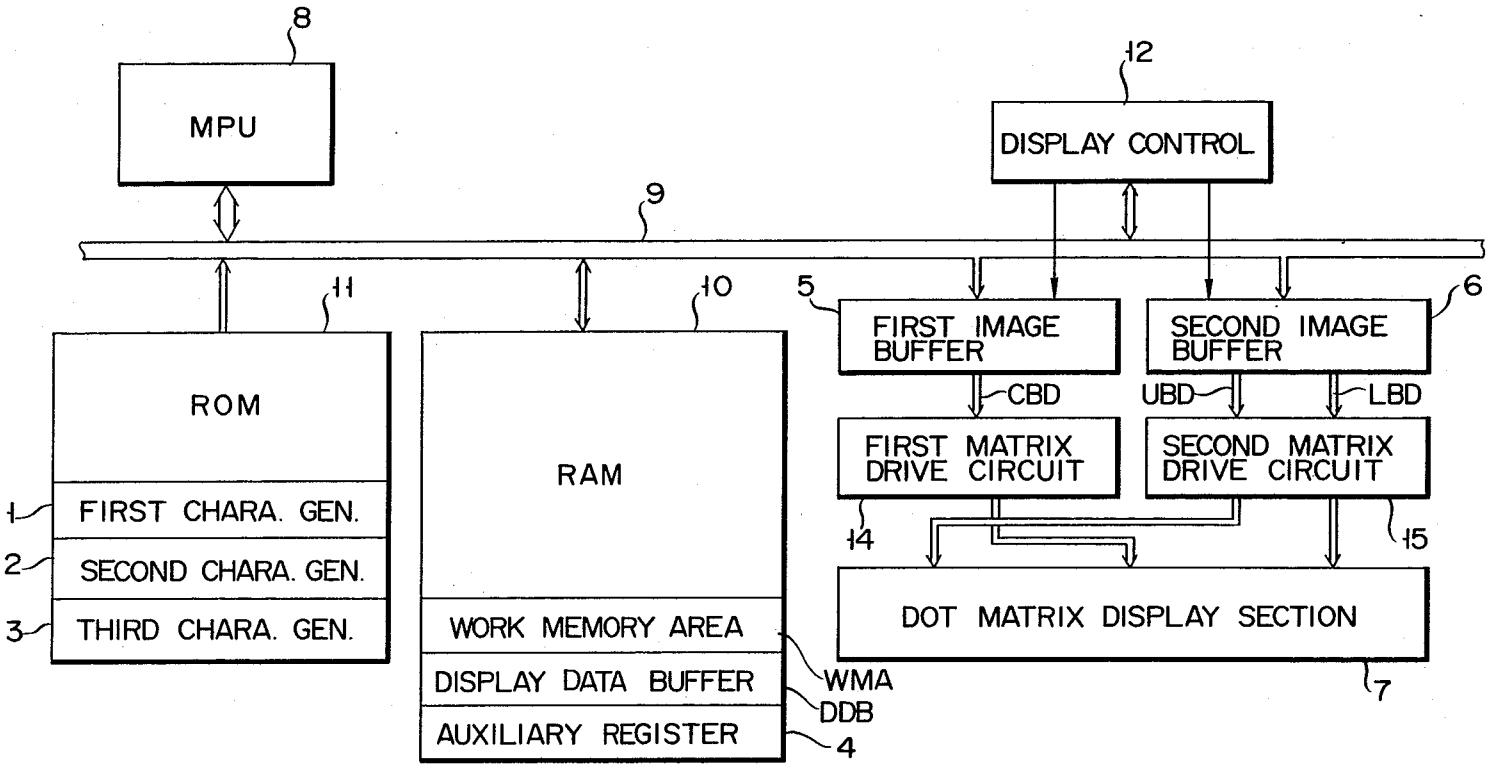
FIG. 6 is a block diagram of the dot character display apparatus according to an embodiment of the invention.

FIG. 6 is a block diagram showing a schematic arrangement of the dot character display apparatus of the invention. This dot character display apparatus includes a microprocessor (MPU) 8 which includes therein various kinds of control programs and which performs various kinds of arithmetic operating processes. MPU 8 is connected through a data bus 9 to a RAM 10 for temporarily storing variable data such as character codes inputted from the outside; a ROM 11 storing the control programs and including first, second, and third character generators 1, 2, and 3; first and second image buffers 5 and 6; and a display control circuit 12 for controlling transfer of data from first and second image buffers 5 and 6.

RAM 10 has a work memory area WMA for storing data to execute various kinds of arithmetic operations; a display data buffer DDB for temporarily storing character code inputted from the outside and are displayed; auxiliary register 4 for storing the respective bit data of the dot patterns of the upper and lower symbols read out from second and third character generators 2 and 3.

An output signal CBD of first image buffer 5 having storage areas $B_1$ to $B_8$ for storing the bit data of the first to eighth bits is sent to a first matrix drive circuit 14 to drive respective dot display elements 7A locating in the central display area, namely, on the fifth to twelfth rows of the dot matrix display section. Similarly, an output signal UBD from the positions corresponding to upper four bits of second image buffer 6 having storage areas $B_9$ to $B_{16}$ to store the bit data of ninth to sixteenth bits is sent to a first input port of a second matrix drive circuit 15 to drive respective dot display elements 7B locating in the upper display area, namely, at the first to fourth rows of dot matrix display section 7 and respective dot display elements 7C locating in the lower display area, namely, at the thirteenth to sixteenth rows. On the other hand, an output signal LBD from the positions corresponding to lower four bits of second image buffer 6 is sent to a second input port of second matrix drive circuit 15.

Figure 7:
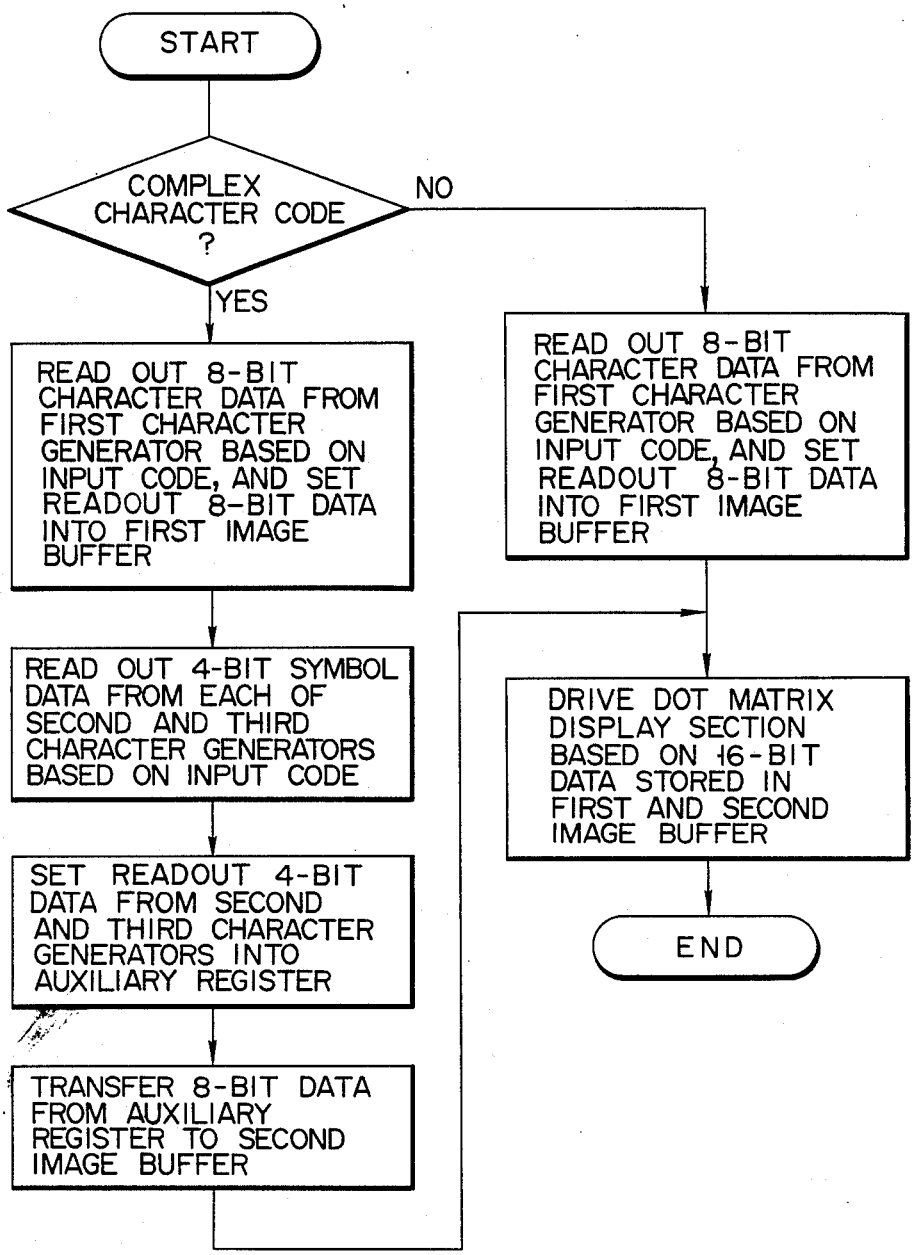
FIG. 7 is a flowchart showing the operation of the dot character display apparatus shown in FIG. 6.

When code data of character to be displayed is inputted from the external control section to MPU 8, MPU 8 temporarily stores the character code data into display data buffer DDB in RAM 10. MPU 8 then sequentially reads out one character code by one from display data buffer DDB and allows desired characters to be displayed in the dot matrix display section in accordance with a flowchart shown in FIG. 7. Namely, in the case where the character code data read out from display data buffer 13 in RAM 10 is the complex character code consisting of a character body and a symbol added to this character main body, the bit data of one column of the dot pattern of this character body is read out from first character generator 1 on the basis of the character code in the input character code data and is directly stored into storage areas $B_1$ to $B_8$ in first image buffer 5.

Next, in accordance with the code indicative of the upper symbol among the input character code data, the 4-bit data of one column of the corresponding dot pattern is read out from second character generator 2 and stored at upper bit positions $B_1$ to $B_4$ of auxiliary register 4. Further, on the basis of the code representative of the lower symbol among the input character code data, the 4-bit data of one column of the corresponding dot patterns is read out from third character generator 3 and stored into lower bit positions $B_5$ to $B_8$ of auxiliary register 4. After completion of storage of the respective bit data into auxiliary register 4, the 8-bit data stored in auxiliary register 4 is read out and stored in the ninth to sixteenth bit positions of second image buffer 6.

After completion of storage of the respective 8-bit data into first and second image buffers 5 and 6, the 8-bit data in first image buffer 5 is sent to first matrix drive circuit 14. Also, the 8-bit data in second image buffer 6 is sent to second matrix drive circuit 15.

When display control circuit 12 permits first matrix drive circuit 14 to receive the 8-bit data indicative of the character body from first image buffer 5, this drive circuit selectively energizes dot display elements 7A locating in the central display region of dot matrix display section 7. Therefore, by sequentially reading out the bit data of each column of the dot pattern corresponding to the input character code data from first character generator 1 and similarly processing them, the dot pattern of the character body is displayed in the central display area of dot matrix display section 7. On one hand, when display control circuit 12 permits second matrix drive circuit 15 to receive two sets of 4-bit data indicative of the upper and lower symbols from second image buffer 6, second matrix drive circuit 15 selectively energizes dot display elements 7B in the upper display area of dot matrix display section 7 in accordance with the 4-bit data indicative of the upper symbol and at the same time selectively energizes dot display elements 7C in the lower display area on the basis of the 4-bit data representative of the lower symbol. Thus, by sequentially reading out the bit data of each column of the dot pattern corresponding to the input character code data from second and third character generators 2 and 3 and similarly processing them, the upper symbol is displayed in the upper display area of the dot matrix display section and the lower symbol is displayed in the lower display area. In the case where the complex character code data read out from display data buffer DDB does not include the lower symbol, the bit data is read out from only first and second character generators 1 and 2, so that the lower symbol is not displayed in the lower display area of dot matrix display section 7. Even in the case where the complex character code data includes only the lower symbol, the upper symbol is not displayed in the upper display area in dot matrix display section 7.

If the character code data read out from display data buffer DDB is not the complex character code but the character code consisting of only an ordinary character body, the 8-bit data of a corresponding column of the dot pattern is read out from only first character generator 1 and may be stored into first image buffer 5.

According to the dot character display apparatus constituted as described above, for example, if the character codes which had been inputted from the external control section and temporarily stored into display data buffer 13 in RAM 10 and were again read out therefrom are the complex character codes indicative of the complex character, the 8-bit data representative of the dot pattern of one column of the character body of this complex character is read out from first character generator 1 and directly stored into first image buffer 5. In addition, the 4-bit data of a corresponding column of the dot pattern of the upper symbol is read out from second character generator 2 and stored in the upper bit positions of auxiliary register 4. The 4-bit data of a corresponding column of the dot pattern of the lower symbol read out from third character generator 3 is stored in the lower bit positions of auxiliary register 4. Thereafter, the 8-bit data stored in auxiliary register 4 is stored into second image buffer 6. The first matrix drive circuit is driven by the bit data stored in first image buffer 5. The second matrix drive circuit is driven by the bit data stored in second image buffer 6.

The output bit data from the upper and lower bit positions of second image buffer 6 for storing the two sets of 4-bit data of each column of the dot patterns indicative of the upper and lower symbols of the complex character is sent to second matrix drive circuit 15 to selectively energize respective dot display elements 7B and 7C locating in the upper and lower display areas of dot matrix display section 7 as described above. Therefore, the output bit data of first image buffer 5 for storing the respective 8-bit data of one column of the dot pattern of the character body can be sent to first matrix drive circuit 14 to selectively energize respective dot display elements 7A in the central display area of dot matrix display section 7.

Figure 1:
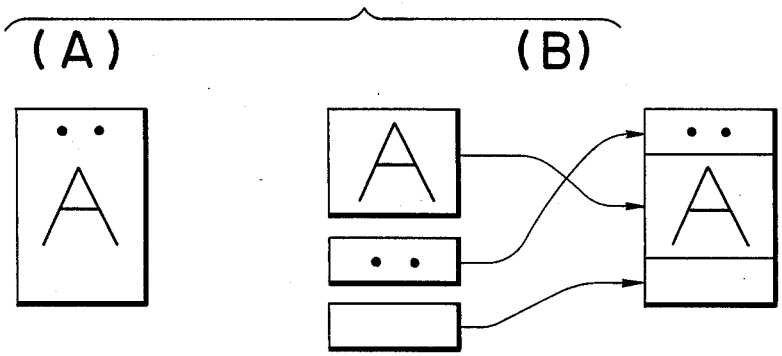
FIG. 1 (PRIOR ART)
FIGS. 1(A) and 1(B) show a conventional method of forming a complex character consisting of a character body and an upper symbol.
Figure 2:
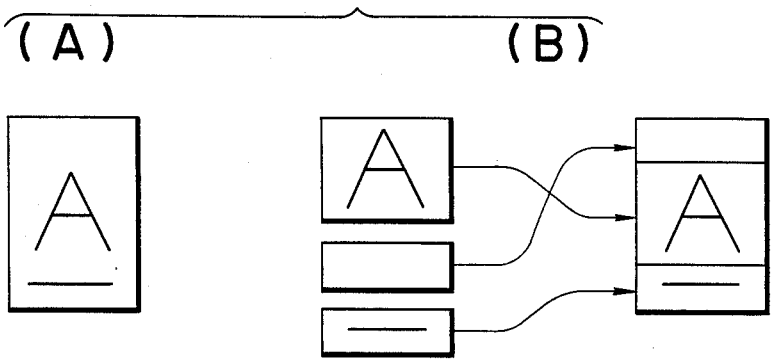
FIG. 2 (PRIOR ART)
FIGS. 2(A) and 2(B) show a conventional method of forming a complex character consisting of a character body and a lower symbol.
Figure 3:
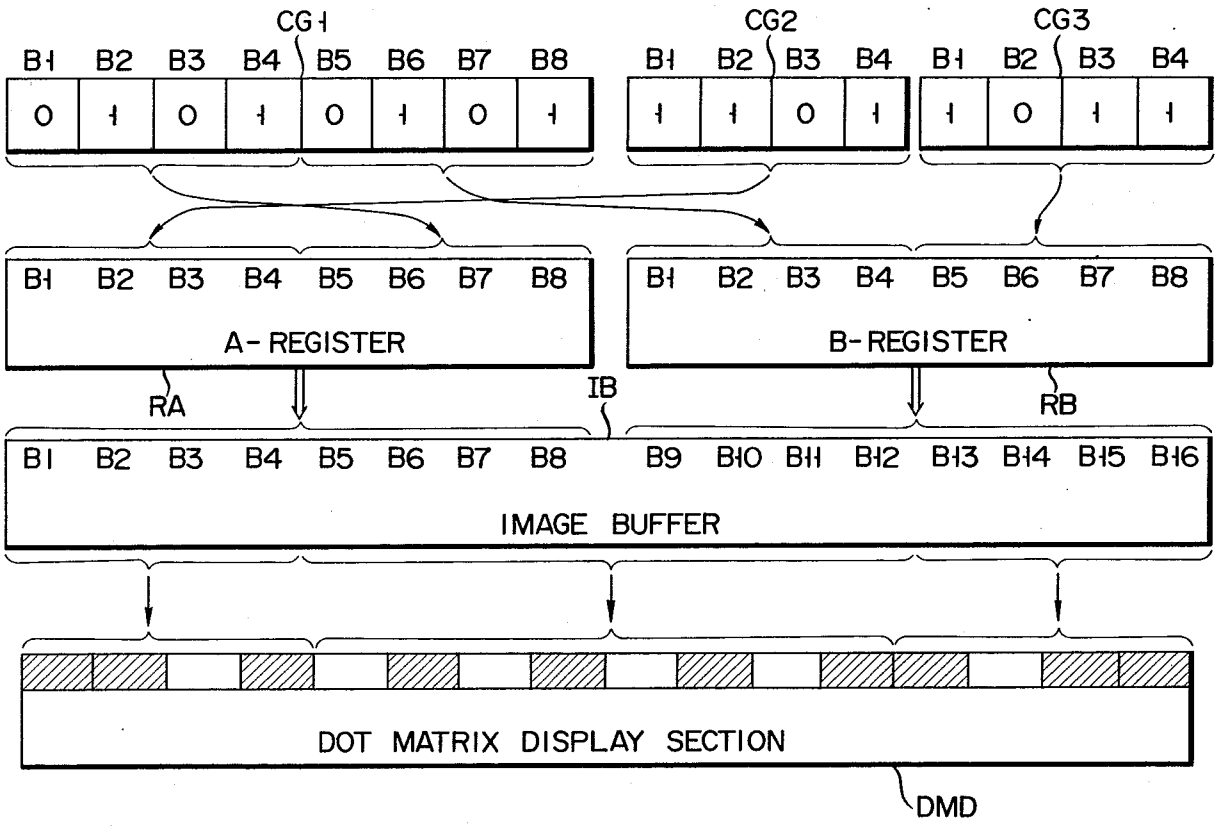
FIG. 3 (PRIOR ART)
FIG. 3 shows a transfer state of bit data in a conventional dot character display apparatus.
Figure 4:
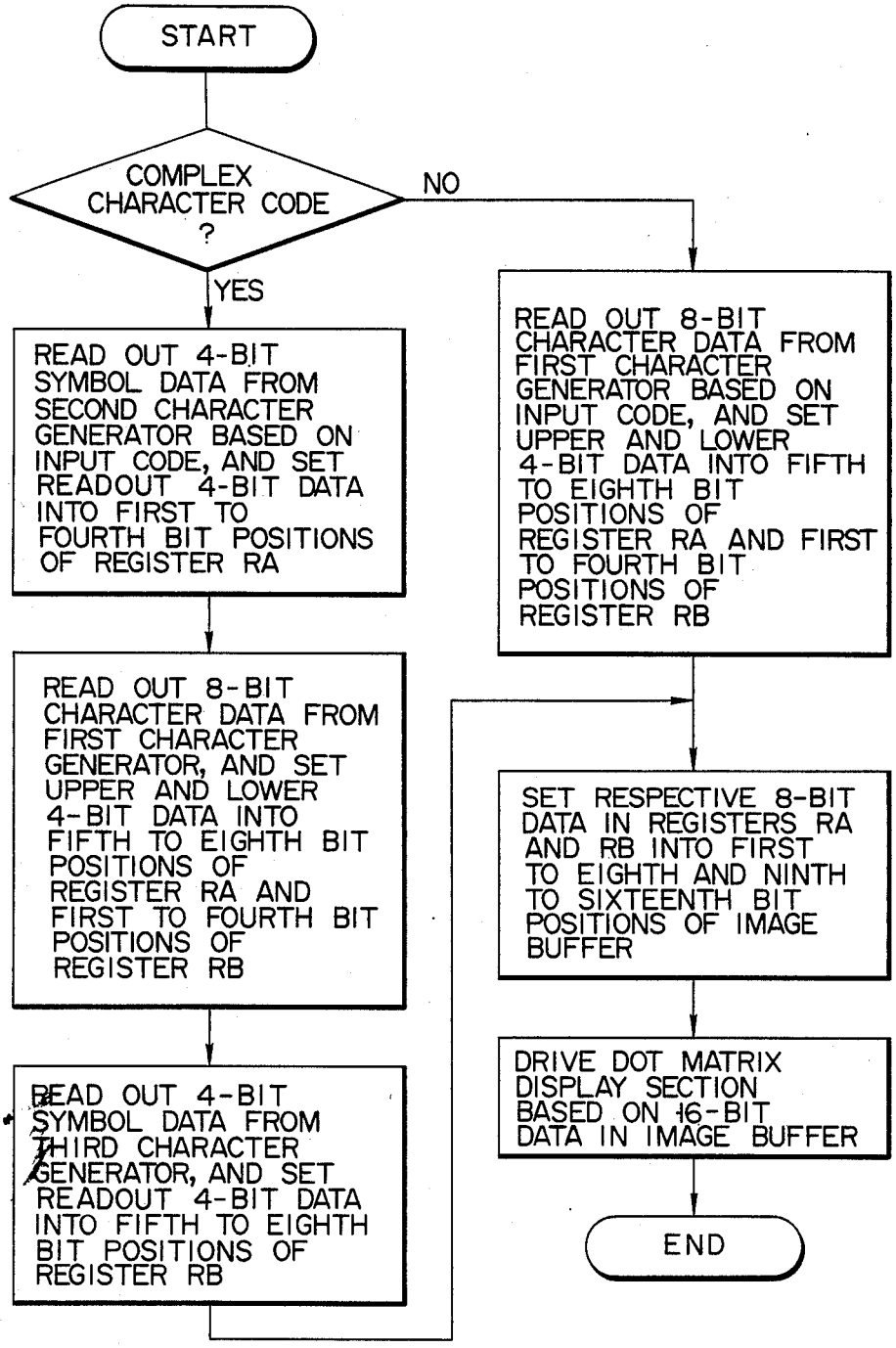
FIG. 4 (PRIOR ART)
FIG. 4 is a flowchart showing the operation of a conventional dot character display apparatus.

In the case of displaying the character body constituting the complex character in dot matrix display section 7 by controlling the transfer of the respective bit data as described above, the respective bit data contained in the dot pattern of the character body read out from first character generator 1 can be directly stored into first image buffer 5. Therefore, unlike the conventional technology shown in FIG. 3, the A-register to store the bit data read out from first and second character generators $CG_1$ and $CG_2$ becomes unnecessary. Moreover, the control program to store the bit data of the character body into the A register also becomes unnecessary. Therefore, the necessary memory capacity can be reduced and the data processing speed can be increased.

The present invention is not limited to the foregoing embodiment. Although the fundamental unit of the character data from the first character generator 1 is constituted by eight bits in the embodiment, it may be set to sixteen bits as necessary.

In addition, in the case of transferring the bit data from second and third character generators 2 and 3 into image buffer 6, for example, the following method may be used. Namely, the 4-bit data from second character generator 2 is first set in the upper 4-bit positions of image buffer 6 followed by lower four bits of "0" and thereafter logical sum of the 8-bit data which is stored in image buffer 6 and the 8-bit data which is constituted by the lower 4-bit data from third character generator 3 and the upper four bits of "0" is obtained. The 8-bit data corresponding to the logical sum can be stored into image buffer 6. In this case, auxiliary register 4 can be omitted.

What is claimed is:

1. An apparatus for displaying a dot matrix, comprising:

first character generating means for generating a plurality of dot patterns of character body data;

second character generating means for generating at least one dot pattern of an upper symbol;

third character generating means for generating at least one dot pattern of a lower symbol;

first image buffer means for storing received data and coupled to said first character generating means to receive dot patterns of character body data;

second image buffer means for storing received data and including upper and lower memory areas coupled to respective ones of said second and said third character generating means to receive dot patterns corresponding to said upper and said lower symbols;

first and second matrix drive circuits coupled to said first and said second image buffer means;

dot matrix display means coupled to said first and said second image buffer means having a central display area which is connected to be driven by said first matrix drive circuit, and upper and lower display areas which are connected to be driven by said second matrix drive circuit; and control means for allowing data corresponding to the dot patterns from said first to third character generating means to be stored into said first image buffer means and the upper and lower memory areas in said second image buffer means, respectively, for controlling said first matrix drive circuit in accordance with the data corresponding to the dot patterns in said first image buffer means, and for allowing the central display area of said dot matrix display means to display the data corresponding to the dot patterns in said first image buffer means, and at the same time controlling said second matrix drive circuit in accordance with the data corresponding to the dot patterns in said second image buffer means, for allowing the upper and lower display areas of said dot matrix display means to display the data corresponding to the dot patterns in said second image buffer means.

2. A dot matrix display apparatus according to claim 1, wherein said first image buffer means is a 2N-bit buffer and said second image buffer means is a 2N-bit buffer having an upper N-bit buffer section and a lower N-bit buffer section, wherein N is a positive integer.

3. A dot matrix display apparatus according to claim 2, which further comprises a 2N-bit register and in which said control means allows the 2N-bit data from said second and third character generating means to be transferred to said second image buffer means through said 2N-bit register.

4. A dot matrix display apparatus according to claim 2, wherein the central display area of each column of said dot matrix display means is constituted by 2N display elements.

* * * * *